United States Patent [19]

Jamieson

[11] 4,232,116

[45] Nov. 4, 1980

[54] LIGHT-HANDLEABLE PHOTOGRAPHIC MATERIALS

[75] Inventor: Peter B. Jamieson, Harlow, England

[73] Assignee: Minnesota Mining and Manufacturing Company, Saint Paul, Minn.

[21] Appl. No.: 7,949

[22] Filed: Jan. 31, 1979

Related U.S. Application Data

[63] Continuation of Ser. No. 719,289, Aug. 31, 1976, Pat. No. 4,140,531.

[51] Int. Cl.[3] ..... G03C 1/84

[52] U.S. Cl. ..... 430/510; 430/30; 430/512; 430/513; 430/517; 430/568; 430/966; 430/967

[58] Field of Search ..... 96/84 R, 94 R, 107; 430/30, 568, 510, 966, 967, 512, 513, 517

[56] References Cited

U.S. PATENT DOCUMENTS

| | | | |
|---|---|---|---|
| 3,156,564 | 11/1964 | Wartburg | 96/107 |
| 3,314,794 | 4/1967 | Sawdey | 96/840 V |
| 3,672,898 | 6/1972 | Schwan et al. | 96/84 R |
| 3,679,409 | 7/1972 | Buckler et al. | 96/84 R |
| 3,737,313 | 6/1973 | Rosecrants et al. | 96/94 R |
| 3,746,539 | 7/1973 | Ohmatsu et al. | 96/84 R |
| 3,756,815 | 9/1973 | Schlein et al. | 96/84 R |
| 3,784,381 | 1/1974 | Perignon | 96/94 R |
| 4,071,366 | 1/1978 | Bourgeois et al. | 96/84 R |
| 4,140,531 | 2/1979 | Jamieson | 96/84 R |
| 4,144,065 | 3/1979 | Lambert et al. | 96/84 R |

OTHER PUBLICATIONS

Duffin, Photographic Emulsion Chemistry, The Focal Press, 11/69, p. 61.

*Primary Examiner*—Jack P. Brammer
*Attorney, Agent, or Firm*—Cruzan Alexander; Donald M. Sell; Mark A. Litman

[57] ABSTRACT

Ultraviolet radiation sensitive photographic film material comprising a silver halide emulsion of at least 50 mole % silver chloride and a yellow filter dye over said silver halide emulsion layer.

14 Claims, No Drawings

LIGHT-HANDLEABLE PHOTOGRAPHIC MATERIALS

This is a division of application Ser. No. 719,289 filed Aug. 31, 1976, now U.S. Pat. No. 4,140,531.

LIGHT-HANDLEABLE PHOTOGRAPHIC MATERIALS

This invention relates to photographic materials and, in particular, to film materials for use in the recording of radiographic images.

Radiographic films based on silver halides have a natural sensitivity to blue visible light and also to ultra violet radiation, and while they are sensitive to direct X-rays, their speed to direct X-rays is extremely slow as compared with that to blue light and ultra violet radiation. Accordingly, it is normal practice to place the radiographic film in face to face contact with one or two light emitting phosphor screens which emit a light pattern corresponding to the X-ray radiation pattern to which they are subjected. Thus, the radiographic film records the light image emitted by the phosphor screens and so indirectly the X-ray pattern. This procedure is particularly important in the taking of medical radiographs where the duration of exposure of a patient to X-rays must be reduced to a minimum and so the speed of the overall system must be as high as possible.

To achieve good speed and sensitivity for the whole system, X-rays, phosphor screen and radiographic film, the latter should have its greatest sensitivity in the region where the phosphor fluoresces when struck by the X-rays. This is frequently at the blue end of the visible spectrum. The radiographic film is therefore sensitive to white light, and to prevent fogging, must be handled under red or orange safelights. Even though screens which emit wholly ultra violet light have been available, the radiographic films proposed for use with them still have considerable white light sensitivity which renders their handling difficult.

Similar problems arise in connection with other ultra violet sensitive materials such as some office copying materials, recording films for use with special instruments, phototype-setting materials, etc., where the materials are also sensitive at least to blue light and so cannot be handled under daylight or normal lighting conditions.

Accordingly, it is an object of this invention to provide ultra violet radiation sensitive material which can be handled under virtually white light without significant fogging.

According to the invention there is provided ultra violet radiation sensitive film material comprising a base having at least one layer of a photographic silver halide emulsion and a yellow filter dye screening the emulsion from visible radiation, the silver halide in the emulsion comprising at least 50 mole % silver chloride, the remainder of the silver halide, if any, being silver bromide and/or silver iodide, whereby the silver halide emulsion has a high natural sensitivity to ultra violet radiation and a low visible light sensitivity, the yellow filter dye having an optical density of no more than 0.3 over an ultra violet wavelength region within the range of wavelengths of from 250 to 380 nm, whereby the emulsion can respond to ultra violet radiation emitted in this ultra violet wavelength region, having an optical density which increases with wavelength from 380 nm to reach a figure of at least 1.0 by 420 nm, and having an optical density which above 420 nm does not proportionately decrease with wavelength any faster than any decrease with wavelength in the log. Sensitivity of the silver halide emulsion, and the material having a sensitivity such that upon development under standard conditions (as herein defined) after exposure to light of wavelengths of 460 to 520 nm gives an optical density of no more than 0.1 over chemical fog plus base with 0.2 erg/mm$^2$ equienergy spectral exposure.

The standard conditions of development as used here are that the film material is developed for 2½ minutes at 20° C. in a developer of the following formulation:

| | |
|---|---|
| Water | 600 mls |
| Hexametaphosphate | 2.2 g |
| Methyl-p-aminophenol sulfate | 2.2 g |
| Sodium sulphite | 72 g |
| Hydroquinone | 8.8 g |
| Sodium carbonate | 48 g |
| Potassium bromide | 4.0 g |
| Distilled water to | 1 liter |

The film material is then rinsed, fixed, washed and dried. The developed density is measured. This developing solution merely provides a reference basis for the characteristics of the film. Any reasonable developer solution and most, if not all, commercially available black-and-white developer solutions can be used with these film elements.

Such a material can be made highly sensitive to ultra violet radiation such as that emitted by a phosphor screen and so, when the material is used in radiography, the overall system can be relatively fast for X-ray imaging. The yellow filter dye should be chosen so that it is sufficiently transparent to ultra violet radiation to allow a high proportion of the total ultra violet radiation energy to reach the emulsion, while absorbing blue light so that the amount of any visible blue light reaching the emulsion is very low. The emulsion itself, in any case, has a relatively low sensitivity to such blue visible light as compared with its sensitivity to ultra violet radiation and so substantially no fogging will occur when the material is exposed to white safelight conditions. Thus, it can be handled under white safelight conditions, e.g. loaded into a camera and then later developed without danger of fogging. The white safelight conditions must be such that ultra violet radiation of wavelength lower than about 420 nm must be absent, but the remaining visible light may contain lights of all colors of the visible spectrum. Persons working in these white safelight conditions can therefore readily make a clear distinction between colors which is not possible under orange or red safelight conditions however bright the safelight conditions. In medical radiography this is an important advantage since a doctor or radiographer can assess the state of a patient by his color which would not be possible under orange or red light. Also the white safelight conditions can be quite bright, e.g. 50 lux or more without fogging the material of the invention.

The photographic materials of the invention are particularly useful in radiographic applications where they are exposed to the ultra violet light image resulting from the striking of a phosphor screen by an X-ray radiation image. They can, however, be used in other applications such as those noted above where one requires a material which is sensitive to ultra violet radiation and which can also be handled without red or orange safelight conditions.

Therefore, according to another aspect of the invention there is provided an X-ray image recording system comprising ultra violet radiation sensitive film material as described above and at least one phosphor screen capable, when struck by X-rays, of emitting ultra violet radiation which will be received by the emulsion of the film material, the screens having a peak ultra violet emission at the said ultra violet wavelength region within the wavelength range of from 250 to 380 nm.

It is well known in the art that silver halides have a high natural sensitivity to ultra violet radiation and that silver bromide also has a relatively high sensitivity to blue and shorter wavelength visible light, while silver chlorides have a relatively low sensitivity to blue and shorter wavelength visible light. Thus emulsions required for use in the materials of the invention contain at least 50 mole % and preferably at least 75 mole %, of silver chloride, the higher the silver chloride content the lower the natural blue and visible light sensitivity even though the ultra violet radiation sensitivity remains high. The remaining silver halide, if any, will be silver bromide and/or silver iodide but the latter should not normally be present in an amount exceeding 1 mole %. In conventional emulsions sensitising dyes are used to extend the sensitivity of the emulsion to longer wavelengths of visible light. This is not required with the emulsions used in the present invention. One can use a completely silver chloride emulsion.

It also appears to be desirable for the silver halide emulsion to have a relatively large grain size, e.g. an arithmetic mean grain size of from 0.5 to 1.5 microns, up to about 1.7 microns; the preferred mean grain size is in the range of from 1.0 to 1.2 microns. The spread of grain sizes in the emulsion should desirably be low. Thus the distribution of grain sizes should be such that the $\sigma_g$ (as defined below) is not more than 1.35 and is preferably from 1.15 to 1.25. Such emulsions will then have a relatively high ultra violet radiation speed and good contrast.

$\sigma_g$ is one statistical parameter which can be extracted from the frequency distribution of grain sizes. It is particularly useful since it describes in one number the effective spread of grain sizes about the mean size as a fraction of that mean size.

$\sigma_g$ is specifically related to the frequency distribution plotted as a function of the logarithm of the grain sizes and its background and use are described in many places in the literature e.g. "Particle Size: Measurement, Interpretation, and Application" by Riyad R. Frani and Clayton F. Classis published by Wiley in 1963, pages 40 and 41 being particularly relevant.

In practice, $\sigma_g$ is evaluated by plotting the cumulative sum of grain size frequencies and finding from it the grain sizes at which the sum reaches specified percentages of the total cumulative sum (Ap being the grain size A at which the percentage is p)

Then $$\sigma_g = \frac{A_{50}}{A_{15.87}} = \frac{A_{84.13}}{A_{50}}$$

The two values will be equal only if the distribution is truly log. normal and this is a reasonable approximation in the present case.

Even though the silver chloride emulsion should desirably have a relatively large grain size, the resulting emulsion must have a low fog on development, e.g. the fog should be less than 0.15 density over base, and preferably less than 0.10 density over base, upon development with normal X-ray film developing solutions. This can be achieved by, for example, preparing the emulsion in the presence of ammonia, an excess of chloride ions and a tetraazaindene as a grain growth controller.

Therefore according to a further aspect of the invention there is provided a sensitised silver halide emulsion, consisting of at least 50 mole % of silver chloride, the remaining silver halide if any being silver bromide and/or silver iodide with a maximum of 1 mole % of silver iodide, the arithmetic mean grain size of the silver halide grains being from 0.5 to 1.5 microns, and the distribution of grain sizes being such that the $\sigma_g$ (as herein defined) is not more than 1.35, the emulsion having a maximum chemical fog of 0.1 over base when spread as a layer on each side of a polyester film base at a total coating weight of 8 g silver per square meter of base and developed under standard conditions (as herein defined).

Such an emulsion is highly suitable for use as the emulsion in the above described ultra violet radiation sensitive film material. It is, however, also useful in a photographic application where high ultra violet radiation speed is required together with low blue light speed, and good contrast and low fog are also required.

As briefly noted above, the emulsion can have this low fog despite its being a predominantly silver chloride emulsion by forming and growing the silver halide grains in the presence of ammonia and an excess of chloride ions, and growing the grains in the presence of up to 0.001 mole of an azaindene growth controller per mole of silver halide. In some circumstances it may not be necessary for the azaindene to be present during the precipitation or forming of the silver halide grains although this is presently preferred. It appears that the grains prepared in this way tend to have a polygonal habit and not a cubic habit.

The silver halide grains in such emulsions can be grown to the relatively large grain sizes required in the presence of the ammonia and it is surprising that this can be achieved without significant fogging. The ammonia concentrations used during grain growth is preferably from 0.05 to 0.30 N. The chloride ion excess used is preferably from 0.2 to 1.0 mole per mole of silver halide.

The azaindene growth controller is preferably present in a very small amount, e.g. from 0.00001 to 0.0005 mole per mole of silver halide. It appears to act to control or restrain grain growth, giving a low distribution of particle sizes. It is not added in large amounts as has been proposed in some cases to stop grain growth once a desired point of growth has been reached.

The azaindene is preferably a tetraazaindene. Examples of suitable tetraazaindenes are those described in British Pat. No. 1,209,146. These have the general formula:

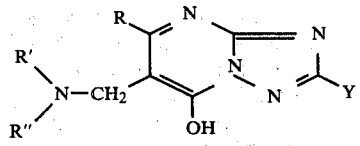

in which R represents a hydrogen atom or an alkyl or alkylthio group, R' and R'', which may be the same or different, represent a hydrogen atom, an alkyl group containing 1 to 6 carbon atoms, or a substituted alkyl group, or R' and R" together form part of a ring, and Y represents a hydrogen atom or an alkyl, alkylthio, aryl or amino group.

A particularly suitable tetraazaindene is:

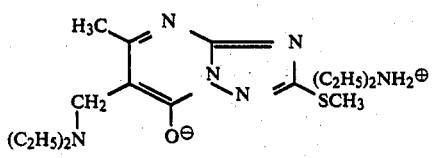

When the film material of the invention is to be used for radiography it will have at least one layer of silver halide emulsion and preferably, in order to give a relatively high silver coating weight, will have two layers of the silver halide emulsion, one on either side of a thin transparent or opaque base such as a conventional polyethylene terephthalate (polyester) film base. The total silver coating weight can be similar to that used in normal radiographic films and will not normally be greater than 10.0 g/m$^2$. Such materials with two layers of emulsion will normally be sandwiched between two ultra violet radiation emitting phosphor screens and optionally an ultra violet filter layer may be provided between the two emulsion layers so that each layer receives ultra violet light almost exclusively from the phosphor screen adjacent to it. In this way sharper images can be obtained in those cases where the emulsion layers are not sufficiently dense to ultra violet radiation to absorb it completely. Alternatively, if a polyester base is used, this will generally absorb radiation of wavelength below about 335 nm.

The yellow filter dye should have a light absorption peak or plateau at around 420 nm and absorb strongly in the wavelength range of 400 to at least 440 nm and preferably as far as the wavelength at which the emulsion gives no more than a developed density of 0.1 above base plus fog upon an exposure of 0.1 erg/mm$^2$ and development under standard conditions (as herein defined above) so that it will filter off substantially all blue visible light of wavelength longer than 400 nm and so prevent that visible light to which the emulsion is slightly sensitive from reaching the silver halide emulsion and light fogging it. The dye should not have appreciable ultra violet radiation absorption in the wavelength region where the screens emit a maximum or substantial output of ultra violet radiation. In this way the emulsion can receive the ultra violet radiation from a screen.

It is well known that in the blue region of the spectrum scattering of light within an emulsion layer contributes considerably to the sensitivity of that layer. Also that the incorporation into the emulsion of a dye absorbing blue light reduces the sensitivity of that layer by several times the nominal density of the dye in the layer because of the increased pathlength produced by the scatter. Therefore we have used herein the term "effective optical density" to define optical density of the dye when in situ in the film material, whether as an overlayer where it represents the nominal density of the dye or mixed in with the emulsion where the nominal density is increased as explained above by the light scattering of the emulsion.

The dye will not have zero absorption of ultra violet radiation in the region of screen emission but, as a man in the art will appreciate, any dye will have wavelengths of radiation to which it will be largely transparent and other wavelengths of radiation to which it will be largely opaque. The yellow filter dye required according to the present invention is chosen after consideration of its absorption spectrum which can be obtained on conventional apparatus. What is desired is a dye having a peak or plateau in its absorption spectrum around 420 nm, which approximates the limit of visible blue light, and a trough or minimum absorption at a wavelength of around 300 nm, preferably extending from 300 to 350 nm, and even more desirably from 250 to 380 nm. In this trough, and particularly at the wavelength of maximum ultra violet emission by the screen, the yellow dye should absorb less than 30% of the radiation of that wavelength. Between this trough and peak there should preferably be a fairly sharp division and we have found that yellow dyes which exhibit this sharp division often tend to have a correspondingly sharp division between the peak at around 420 nm and another trough at wavelengths in the visible range, e.g. 475 to 700 nm. This does not usually matter, however, because according to the invention, the emulsion is chosen so that its sensitivity to visible light, except to the extreme blue, is very low indeed and this extreme blue light at around 420 nm will be filtered off by the yellow dye. Thus any blue light of a wavelength slightly longer than 420 nm, e.g. 440 to 470 nm, may not be as strongly absorbed by the dye as light of wavelengths around 420 nm, but at these wavelengths of 440 to 470 nm th sensitivity of the emulsion will be much less than at 420 nm and will be falling rapidly with increasing wavelength, e.g. a fall of at least one order of magnitude over a wavelength range of 15 to 20 nm, and so the overall material will not be fogged by visible light of these wavelengths.

According to one embodiment of the invention we have found that good results can be achieved with a yellow filter dye having the following properties. Between 290 and 350 nm the optical density should be low and not greater than 0.3 and preferably not greater than 0.1 There should be a gradual rise in density from 350 to 420 nm but preferably the rate should be such that at 380 nm the density is not greater than 0.4. The density should reach a value of at least 1.0 at 420 nm. At wavelengths greater than 420 nm the density can remain high if the dye is bleachable by the developer but should fall if it is not. If the density falls with increasing wavelength it must do this gradually as far as 490 nm and must not be less than 0.4 at 450 nm. For a non-bleachable dye the density should be uniformly low between 490 and 700 nm, preferably below 0.02. The actual amount of dye in the material of the invention should be chosen to give good separation between the amount of ultra violet radiation and visible light received by the emulsion upon exposure.

The yellow filter dye acts as a light filter and it is not intended that it should chemically densitise the silver halide emulsion. Accordingly, the filter dye should be present in or as an outer layer over the silver halide emulsion layer on one or both sides of the base. Such an outer layer can consist solely of the filter dye or can include a binder such as gelatin as well as the dye. The filter layer can also function as an outer supercoat for the material, the gelatin or other binder having been hardened to give an outer protective layer.

Developed images made from the materials of the invention will be given a yellow appearance by the yellow filter dye and so this is preferably a dye which will be bleached during the processing required to develop the exposed silver halide emulsion to give colorless compounds which do not adversely affect the material and leave no stain. Examples of suitable bleachable yellow filter dyes are monomethine oxonol dyes made from barbituric acids, examples of which have the formula:

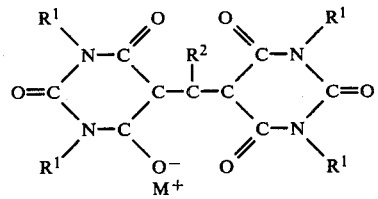

in which $R^1$ represents —H, $CH_3$ or $—C_2H_5$, $R^2$ represents H or $CH_3$, and $M^+$ is a cation (e.g. a metal cation or an organic cation), and which are of a general type of dye which are well known and which can be prepared by conventional methods for making that type of dye. The presently preferred bleachable yellow dyes are, however, those of the general formula:

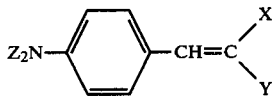

in which X and Y each independently represents CN, $CO_2R$ or $CONH_2$, R represents a lower alkyl group and each Z represents a hydrogen atom or an alkyl group, an aryl group an alkaryl group or an aralkyl group, any of which groups may optionally be substituted.

These dyes can be prepared in the manner described in an article by Jacob Zabisky entitled "The Kinetics and Mechanism of Carboxyl-Methylene Condensation Reactions", Part XI, Stereochemistry of the Products in J.C.S. 1961 starting at page 683.

Two preferred yellow dyes of the group are:

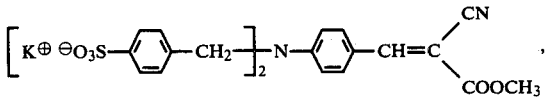

and

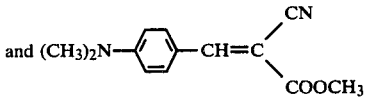

The silver chloride emulsions used in the materials of the invention will develop quickly when contacted with conventional developer solutions, such as radiographic material developer solutions, e.g. that noted above, which are very active and highly alkaline, because of the relatively high solubility of silver chloride as compared with other silver halides. Also these conventional developer solutions will rapidly and completely bleach the bleachable yellow filter dyes examples of which are listed above.

When the materials of the invention are used in radiography, the phosphor screen or screens which are used during the making of a radiograph should have a high ultra violet radiation emission in the range of 250 to 400 nm, and in particular should have a peak emission in the said ultra violet wavelength region within the wavelength range of from 250 to 380 nm, when struck by X-rays. Preferred screen materials will emit ultra violet radiation over a range of wavelengths with a maximum emission in the range of 300 to 350 nm. The blue light emission of such screens should be as low as possible since most if not all of such energy will be absorbed by the yellow filter dye and so wasted from the overall efficiency and speed of the system. The phosphor screen may be an image intensifier against which a piece of material is laid during exposure of the screen to X-rays or alternatively there may be a pair of phosphor screens between which the film material is sandwiched during X-ray exposure.

Suitable ultra violet radiation emitting phosphors for use in these screens are known in the literature. Examples are $BaSi_2O_5$:Pb, $YPO_4$:Ce, $YPO_4$:Gd, and $LaPO_4$:Ce. Other suitable phosphors are those described in the following formula:

$$La_{(1-x-y-z-a)}Gd_xCe_yTb_zTh_aXO_4$$

in which X represents a phosphorus atom or an arsenic atom, x is 0.01 to 0.50 and preferably 0.05 to 0.30, y is 0 or up to 0.50, z is 0 or up to 0.10 and preferably 0 or up to 0.02, a is 0 or up to 0.02, and when X represents a phosphorus atom $y+z+a$ is at least 0.01.

The 'white safelight' conditions under which the materials of the invention can be handled without light fogging can be given by filtering daylight or artificial light as provided by a tungsten or fluorescent lamp through a filter which absorbs light of wavelength shorter than 400 nm so that such radiation is substantially absent.

Therefore according to the invention there is provided a method of recording an X-ray image in which film material according to the invention is loaded under white safelight conditions from which light of a wavelength shorter than 400 nm is substantially absent into a camera in contact with one or more phosphor screens capable when struck by X-rays of emitting ultra violet radiation, the screens having a peak ultra violet emission at the said ultra violet wavelength region with the wavelength range of from 250 to 380 nm, the screen or screens and film material are exposed to the X-ray image, and the film is removed and optionally developed under the said white safelight condition.

A suitable filter material has an optical density of no more than about 0.3 at 430 nm rising to about 3.5 at least by 380 nm and remaining at such a level at shorter wavelengths so as to exclude ultra violet radiation, while beyond a wavelength of 430 nm towards larger wavelengths from 440 to 700 nm the optical density is not more than about 0.15. Examples of such filter materials are commercially available from the Ozalid Company. The resulting white safelight can be bright e.g. at least 50 lux and often 75 lux or more, without substantial fogging of the material. Also it contains light of all colors, even a certain amount of blue, and so all colors can be distinguished when working under such light.

The invention will now be illustrated by the following Examples.

EXAMPLE 1

The following two solutions were prepared:

| | |
|---|---|
| Solution A (at 55° C.) | |
| Insert ossein gelatin | 20 g |
| ammonium chloride solution (2.5M) | 520 ml |
| ammonium bromide solution (2.5M) | 40 ml |
| ammonia solution (12N) | 33 ml |
| water solution of tetraazaindene (the quaternary diethyl ammonium salt of 2-methyl-thio-4-hydroxy-5-diethylamino-6-methyl-1-3,3a,7-tetraazaindene) (0.1% solution) | 33 ml |
| water | 614 ml |
| Solution B (at 48° C.) | |
| silver nitrate solution (2.5M) | 400 ml |
| water | 350 ml |

Solution A was introduced into a precipitation vessel, and solution B was added over a period of one minute with rapid stirring. The mixture was maintained at 55° C. for a further 45 minutes. It was then coagulated by addition of 30 ml of an approximately 30% solution of a sodium alkyl sulphate and 25 ml 5 N sulphuric acid, followed by cooling to 20° C. The supernatant liquid was removed by decantation and the coagulum washed with cold water. The emulsion was re-dispersed, firstly in a solution at 45° C. containing 15 g gelatin, 50 ml industrial spirit and 100 ml water, and afterwards at 45° C. in 50 g gelatin, 50 ml water and 10 ml phenol.

The emulsion was chemically sensitised by adding 60 ml of 0.5 mM sodium thiosulphate and 10 ml of 0.25 mM sodium gold chloride solution and heating at 55° C. until chemical sensitisation was complete (approx. 1 hour), when 0.38 g of 4-hydroxy-6-methyltetraazaindene was added as stabilizer and the emulsion cooled to 40° C. Before coating, 5 ml of a 30% solution of sodium alkyl sulphate as wetting agent, 15 g of the following yellow filter dye:

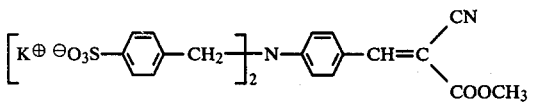

and 0.3 g mucochloric acid as hardener were added. This filter dye had an absorption spectrum as showing in the accompanying Figure.

Optionally, an anti-foggant of the azodicarbonamide type as described in German Offenlegungschrift No. 1,944,745, German Offenlegungschrift No. 2,218,214, British Pat. No. 1,351,463, German Offenlegungschrift No. 2,221,024 and U.S. Pat. No. 3,819,380 and polymers such as those of the polyethylacrylate or polyvinylpyrrolidone types could have been added to reduce fog and graininess. Finally a sufficient quantity of distilled water was added so as to obtain a total mass of 2000 g.

The emulsion thus prepared was applied to both sides of a polyethylene terephthalate support in the amount of 4 g/m$^2$ of silver on each side, and covered with a protective layer of gelatin, set and dried.

The mean grain size of the resulting emulsion was about 1.1$\mu$ and there was a relatively narrow spread of grain sizes such that the $\sigma_g$ was 1.25.

The sensitivity of the coated emulsion to ultra violet radiation and to 'white safelight' (400 nm upwards) was measured. Sensitivity to ultra violet radiation was about 0.15 log E less than for an iodobromide emulsion of similar mean grain size; however, exposure to white safelight (400 nm upwards) of 75 lux for 30 seconds produced a fog increase of only 0.1 density, whereas by comparison a conventional film was instantly fogged to maximum density.

In a practical demonstration, a cassette containing Kodak 'Fine' intensifying screens was loaded with the film in 50 to 100 lux 'white safelight'. An exposure to X-rays was made at the same settings required for the Kodak film, and the film developed by hand for 2 minutes in 'white safelight' in a developer of the following composition:

| | |
|---|---|
| sodium sulphate | 72 g |
| Metol | 2.2 g |
| hydroquinone | 8.8 g |
| sodium carbonate | 48 g |
| potassium bromide | 4.0 g |
| water to | 1.0 liter. |

An acceptable radiograph without stain was obtained, although the maximum density was somewhat less than ideal, which was thought to be a consequence of the screens emission not being exactly matched to the film sensitivity.

EXAMPLE 2

The procedure of Example 1 was repeated except that the yellow dye used was a monomethine oxonol dye made from barbituric acid. There was again low sensitivity to the white light (although higher than for the emulsion prepared in Example 1) with maintained ultra violet sensitivity.

EXAMPLE 3

A pure chloride emulsion was made as follow:

| | |
|---|---|
| Part A at 60° C. | |
| gelatin | 50 g |
| $NH_4Cl$ (2.5M) | 1280 ml |
| water solution of tetraazaindene* (0.10%) | 100 ml |
| $NH_4OH$ (12M) | 20 ml |
| water | 575 ml |
| Part B at 50° C. | |
| $AgNO_3$ (2.5M) | 800 ml |
| water | 3200 ml |

*As in Example 1 above.

Part B was jetted into part A over a period of 10 minutes, and the emulsion ripened at 55° C. for 30 minutes. This gave polyhedral grains of average size 0.81$\mu$ and a $\sigma_g$ of 1.25.

EXAMPLE 4

Two bromochloride emulsions were made identically apart from one (1) having the above tetraazaindene grain growth controller present, the other (2) not.

| | Emulsion (1) | Emulsion (2) |
|---|---|---|
| Part A at 55° C. | | |
| gelatin | 25 g | 25 g |
| water | 1000 ml | 1000 ml |
| $NH_4OH$ (12M) | 20 ml | 20 ml |
| $NH_4Cl$ (2.5M) | 120 ml | 120 ml |
| Part B at 50° C. | | |
| $NH_4Cl$ (2.5M) | 300 ml | 300 ml |
| $NH_4Br$ (2.5M) | 100 ml | 100 ml |
| tetraazaindene solution* (0.1%) | 30 ml | 30 ml |
| water | 587 ml | 600 ml |
| Part C at 50° C. | | |

-continued

| | Emulsion (1) | Emulsion (2) |
|---|---|---|
| $AgNO_3$ (2.5M) | 400 ml | 400 ml |
| water | 600 ml | 600 ml |

*As in Example 1 above.

Parts B and C were jetted into A over a period of 25 minutes and stirred for a further 20 minutes. Emulsion (1) gave polyhedral grains of average size 1.5μ and $\sigma_g$ of 1.3. Emulsion (2) gave a variety of grain shapes excluding large triangular plates with wide size range 1.2μ to 3.4μ.

What is claimed is:

1. Ultraviolet radiation sensitive photographic film material comprising:

1. a base,
2. at least one layer adjacent to said base comprising a photographic silver halide emulsion, and
3. a yellow filter dye layer adjacent to and over said at least one emulsion layer, the silver halide in said silver halide emulsion comprising at least 50 mole % silver chloride and the remainder comprising silver bromide and silver iodide whereby the emulsion has a high natural sensitivity to ultra violet radiation and a low visible light sensitivity, said yellow filter dye layer having an optical density of no more than 0.3 between 250 and 380 nm, an optical density which increases from 380 to 420 nm to at least 1.0, and an optical density above 400 nm which proportionately does not decrease any faster with increasing wavelengths than does the log. sensitivity of said silver halide emulsion, and said film material having a sensitivity to radiation such that upon image-wise exposure to radiation of 460 to 520 nm and development for 2½ minutes at 20° C. in a developer comprising:

| | |
|---|---|
| methyl-p-aminophenol sulfate | 2.2 g |
| hydroquinone | 8.8 g |
| sodium carbonate | 48.0 g |
| sodium sulfite | 72.0 g |
| potassium bromide | 4.0 g |
| hexametaphosphate | 2.2 g |
| distilled water to | 1000 ml |

followed by conventional rinsing, fixing, and drying, gives an optical density of no more than 0.1 above chemical fog plus base, where said image-wise exposure is to 0.2 erg/mm$^2$ of an equienergy spectrum light restricted to a wavelength band of 460 to 520 nm.

2. Film material as claimed in claim 1 in which the emulsion comprises at least 75 mole % of silver chloride.

3. Film material as claimed in claim 1 in which the emulsion comprises at least 90 mole % of silver chloride.

4. Film material as claimed in claim 1 in which the emulsion comprises substantially 100 mole % of silver chloride.

5. Film material as claimed in claim 1 in which the yellow dye has an effective optical density of no greater than 0.3 in the wavelength range of from 290 to 350 nm, a rise in effective optical density with increase in wavelength from 350 to 420 nm such that the effective optical density is no more than 0.4 at 380 nm and is at least 1.0 at 420 nm, and an effective optical density of not less than 0.4 at 450 nm.

6. Film material as claimed in claim 5 in which the yellow filter dye is bleachable upon development of the film material.

7. Film material as claimed in claim 5 in which the yellow filter dye is non-bleachable upon development of the film material and the effective optical density at wavelengths of from 490 to 700 nm is below 0.02.

8. An X-ray image recording system comprising an ultra violet radiation sensitive film material as claimed in claim 1 and at least one phosphor screen capable, when struck by X-rays, of emitting ultra violet radiation which will be received by the emulsion of the film material, the screens having a peak ultra violet emission at the said ultra violet wavelength region within the wavelength range of from 250 to 380 nm.

9. A system as claimed in claim 8 in which the film material includes a layer of the emulsion on each side of the base and the film material is sandwiched between a pair of the phosphor screens.

10. A system as claimed in claim 8 in which the phosphor screen or screens having a maximum emission in the range of 300 to 350 nm when struck by X-rays.

11. A system as claimed in claim 8 in which the phosphor screen or screens include at least one of the phosphors $BaSi_2O_5$:Pb, $YPO_4$:Ce, $YPO_4$:Gd and $LaPO_4$:Ce.

12. The film material of claim 1 wherein said silver halide emulsion has an arithmetic mean grain size of from 0.5 to 1.5 microns and the distribution of grain sizes being such that the $\sigma g$ is not more than 1.35.

13. The film material of claim 1 wherein silver halide grains were grown in the presence of ammonia.

14. The film material of claim 12 wherein said silver halide grains were grown in the presence of ammonia.

* * * * *